United States Patent [19]

Lanmon, II et al.

[11] Patent Number: 4,756,363

[45] Date of Patent: Jul. 12, 1988

[54] APPARATUS FOR RELEASING A PERFORATION GUN

[75] Inventors: C. P. Lanmon, II, Houston; Terrell E. Dailey, Bellaire, both of Tex.

[73] Assignee: NL Industries, Inc., New York, N.Y.

[21] Appl. No.: 3,568

[22] Filed: Jan. 15, 1987

[51] Int. Cl.[4] ..... E21B 43/116

[52] U.S. Cl. ..... 166/55.1; 175/4.56

[58] Field of Search ..... 166/55, 55.1, 63, 117, 166/297, 317; 175/4.56

[56] References Cited

U.S. PATENT DOCUMENTS

| | | | |
|---|---|---|---|
| 3,706,344 | 12/1972 | Vann | 166/55 X |
| 3,842,914 | 10/1974 | Mott | 166/377 |
| 4,040,482 | 8/1977 | Vann | 166/297 X |
| 4,113,016 | 9/1978 | Trott | 175/4.56 X |
| 4,526,233 | 7/1985 | Stout | 166/297 X |
| 4,603,741 | 8/1986 | Edgmon | 166/317 X |

*Primary Examiner*—Stephen J. Novosad
*Assistant Examiner*—William P. Neuder
*Attorney, Agent, or Firm*—Browning, Bushman, Zamecki & Anderson

[57] ABSTRACT

An improved apparatus for releasing a perforation gun from a tubing string in a well casing is disclosed. The explosion of a detonator that fires the perforation gun opens a previously sealed passageway through a wall of the apparatus of the invention. The passageway transmits bottom hole well pressure to a piston that actuates means for releasing the perforation gun. A secondary release sleeve is also provided to mechanically release the perforation gun when the piston fails to function properly. In an alternate embodiment of the apparatus of the invention, the perforation gun is released when the explosion of the detonator breaks a frangible rod that previously held one or more retaining balls within a recess in a wall of the perforation gun assembly.

14 Claims, 5 Drawing Sheets

FIG. 7
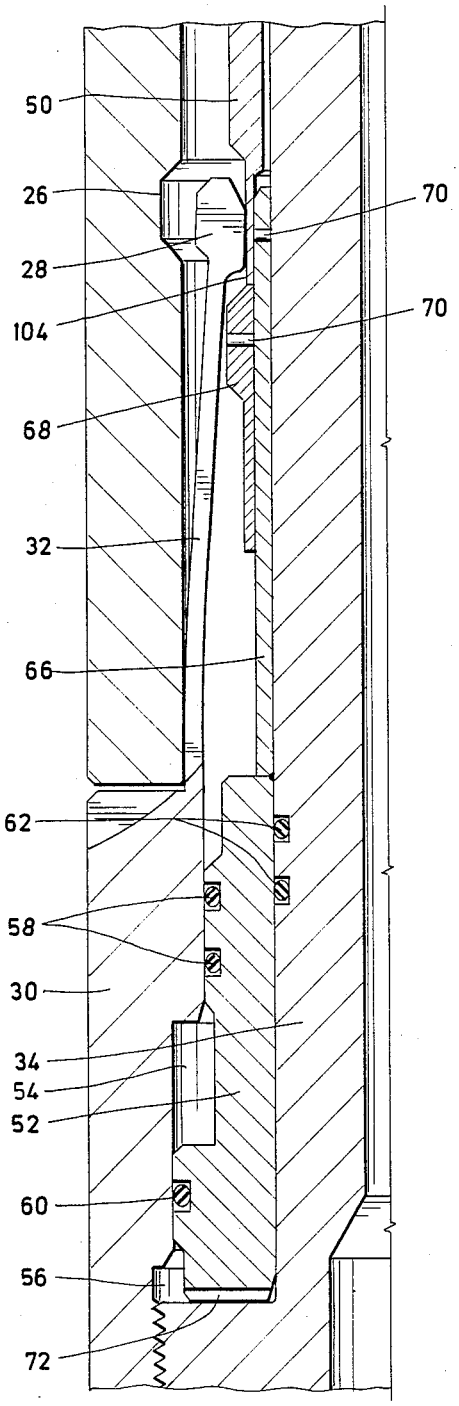
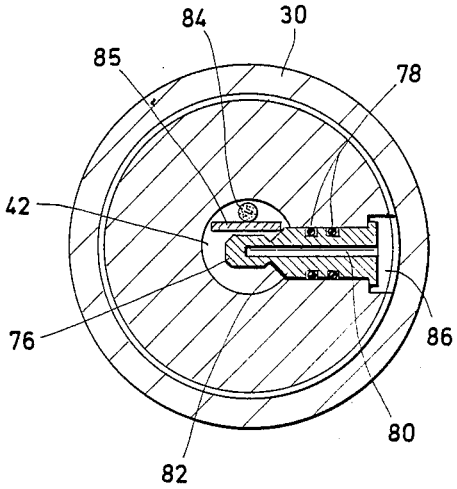
FIG. 5

FIG. 8
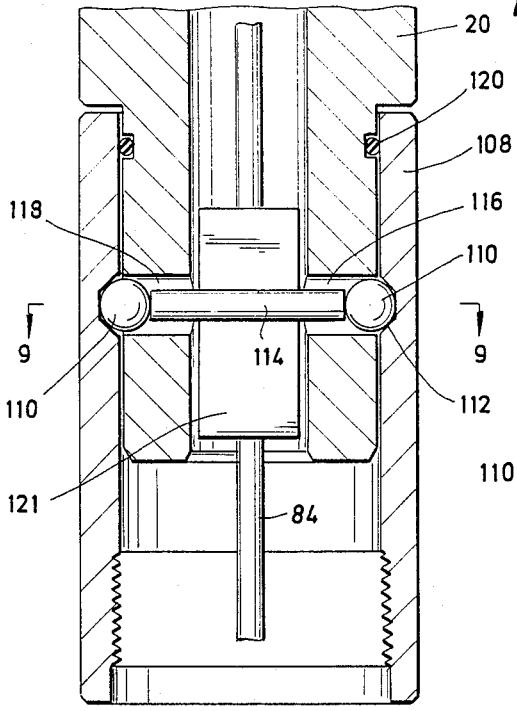
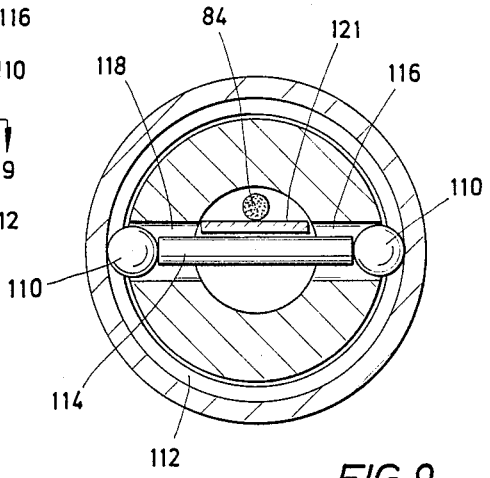
FIG. 9
FIG. 10
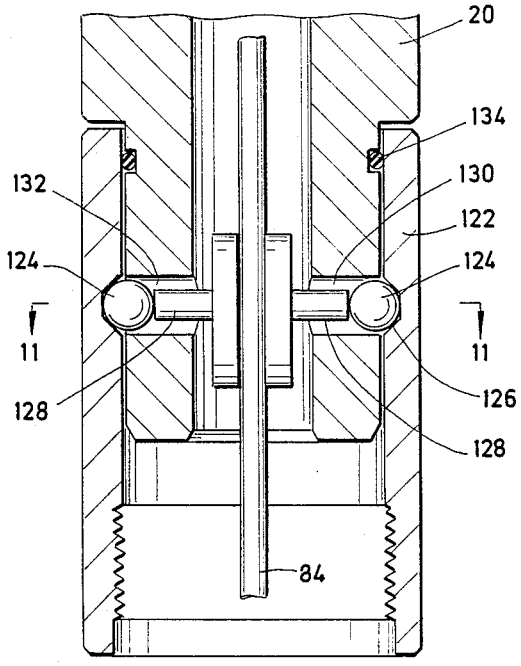
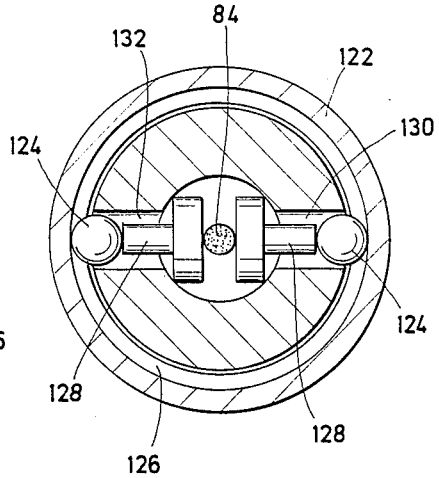
FIG. 11

APPARATUS FOR RELEASING A PERFORATION GUN

BACKGROUND OF THE INVENTION

1. Field of the Invention

This invention relates generally to perforation guns that are used in the oil and gas producing industry to explosively perforate well casing and, in particular, to an improved apparatus for releasing a perforation gun from a tubing string within a well casing after the perforation gun has been fired to perforate the well casing.

2. Description of the Background

In a typical perforation gun assembly for perforating well casing, the gun is mounted at the end of a tubing string and is positioned at the desired location within the casing by lowering the tubing string and the perforation gun down through the interior of the well casing. The gun is usually fired by detonating a cylindrically symmetrical explosive device within the perforation gun assembly. The force of the explosion perforates the casing by puncturing holes within the walls of the casing. The perforation of the casing allows oil and gas from the surrounding geological formation to flow into the interior of the casing where the oil and gas may subsequently be drawn to the surface through the tubing string.

After the perforation gun has been fired, the perforation gun assembly may either be withdrawn from the well bore or be left in the well bore permanently. When the perforation gun assembly is to be left in the well bore, the operator may desire to release the perforation gun assembly from the tubing string to remove any obstruction that it might present to the production of the oil and gas through the tubing string.

One example of a prior art release mechanism is shown in U.S. Pat. No. 4,040,482 issued to Vann on Aug. 9, 1977. In Vann, a releasable coupling from which the perforation gun is suspended is disengaged by means of mechanical dogs pivotally mounted on a releasing member that is lowered to the releasable coupling via a wireline.

Releasable perforation gun assemblies are usually attached to the tubing string via a collet finger/groove connector. In such an arrangement, the release of the perforation gun assembly is achieved by causing the collet fingers that are attached to the perforation gun assembly to move out of engagement with the complementarily shaped groove that is cut into the interior surface of one section of the tubing string. After the collet fingers have been disengaged from the groove, the perforation gun assembly falls to the bottom of the well bore where it does not interfere with the production of the oil and gas through the perforated well casing.

In prior art perforation gun assemblies that have releasable collet finger/groove connectors, the collet fingers may be moved out of engagement with the groove by slidably displacing a retaining sleeve which holds the collet fingers within the groove. Such a retaining sleeve may be displaced by a number of means including a wireline tool, a drop bar or a piston.

When a piston is used to displace the retaining sleeve, there must be a pressure differential in order to cause the piston to move. Some prior art devices utilize the pressure of the gases generated in the firing of the perforation gun to move the piston to displace the retaining sleeve and release the collet fingers. The gas pressure so generated usually must be greater than the well bore pressure. Other prior art devices are so constructed that an untimely leak in the perforation gun will cause a prematurely activated release of the release mechanism.

The present invention overcomes the problems and disadvantages that are inherent in the prior art devices. In the present invention, there is no need to generate a pressure that is greater than bottom hole pressure in order to release the perforation gun assembly from the tubing string. In addition, a premature release will not occur even if the perforation gun happens to leak.

SUMMARY OF THE INVENTION

The apparatus of the present invention efficiently releases the perforation gun assembly by utilizing the explosion of the detonation device that fires the perforation gun to open a previously sealed passageway through a wall of the apparatus of the invention. The passageway transmits the bottom hole pressure to a piston that actuates means for releasing the perforation gun assembly. In the preferred embodiment of the invention, the piston actuates a release sleeve that causes a cam sleeve to move out of engagement with the collet fingers that are seated in a groove cut into an inner wall of the apparatus. When the cam sleeve no longer presses against the collet fingers, the collet fingers slide out of engagement with the groove and the perforation gun assembly is released from the tubing string.

A secondary release sleeve is also provided for mechanically moving the cam sleeve out of engagement with the collet fingers to release the perforation gun assembly. The secondary release sleeve is used when the piston fails to function properly due to fluid leakage, mechanical interference or the like.

It is an object of the invention to provide an apparatus for releasing a perforation gun.

Another object of the invention is to provide means for automatically releasing a perforation gun from a tubing string within a well casing after the perforation gun has been fired to perforate the well casing.

Another object of the invention is to provide an apparatus for releasing a perforation gun in which the release mechanism is activated when the pressure inside the perforation gun assembly equals or nearly equals the bottom hole pressure in the well bore.

Still another object of the invention is to provide a secondary release mechanism for mechanically releasing the perforation gun when the automatic release mechanism is not operable.

Other objects and advantages of the invention will become apparent after reviewing and considering the detailed description and the drawings.

BRIEF DESCRIPTION OF THE DRAWINGS

FIG. 5 is a lateral cross-sectional view of the apparatus of he invention taken along line 5—5 of FIG. 4.

FIG. 7 is a longitudinal cross-sectional view of a portion of the apparatus of the invention showing the operation of a manual release mechanism.

FIG. 8 is a longitudinal cross-sectional view of a portion of a first alternate embodiment of the invention showing an automatic release mechanism.

FIG. 9 is a lateral cross-sectional view of the first alternate embodiment of the invention taken along line 9—9 of FIG. 8.

FIG. 10 is a longitudinal cross-sectional view of a portion of a second alternate embodiment of the invention showing an automatic release mechanism.

FIG. 11 is a lateral cross-sectional view of the second alternate embodiment of the invention taken along line 11—11 of FIG. 10.

DESCRIPTION OF THE PREFERRED EMBODIMENT

Figure 1:
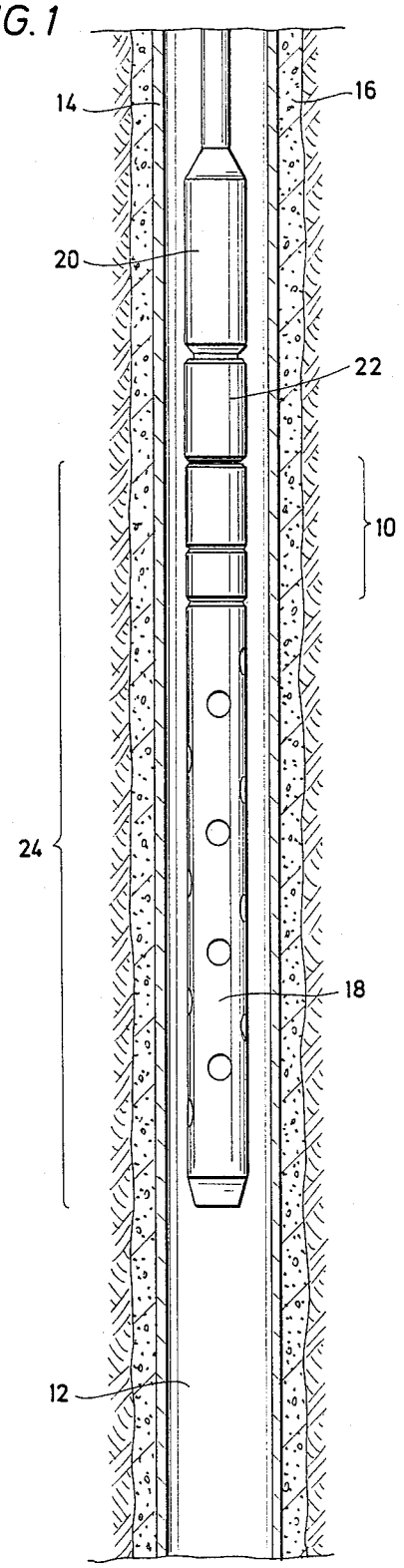
FIG. 1 is a cross-sectional view of a well borehole and a perspective view of a perforation gun and of the apparatus of the invention connected to a tubing string disposed within the asing of said well borehole.
Figure 2:
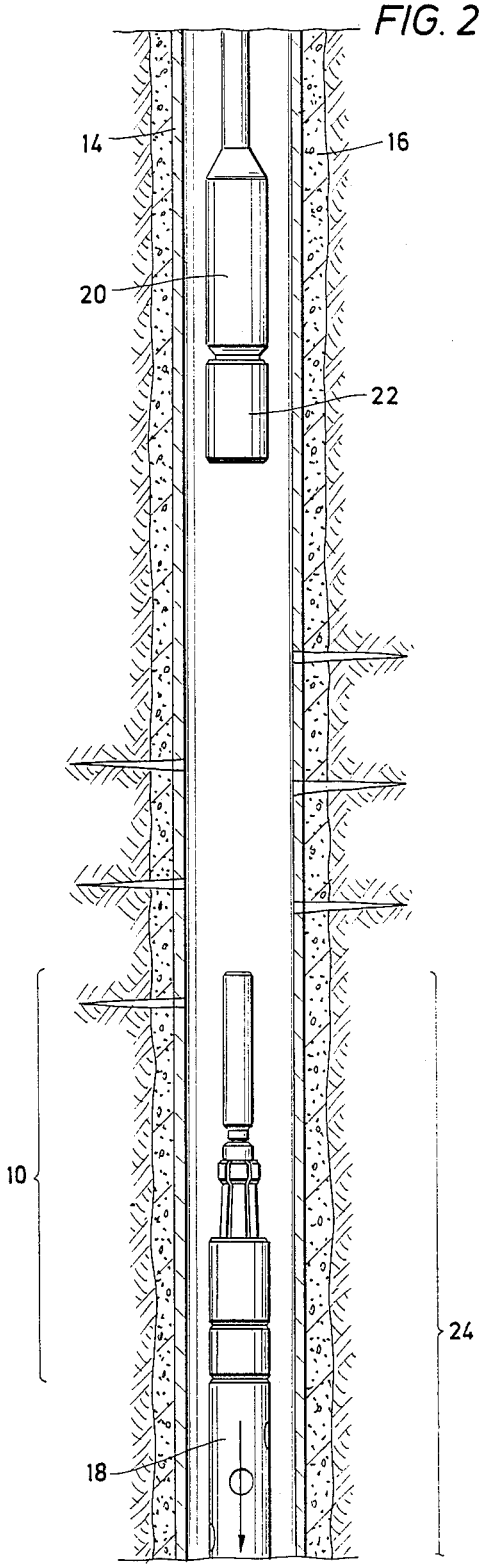
FIG. 2 is a cross-sectional view of a well borehole and a perspective view of a perforation gun and of the apparatus of the invention showing the release of the perforation gun from the tubing string after the perforation gun has been fired.

FIG. 1 depicts the apparatus 10 of the present invention disposed within a well bore 12. The well bore 12 is lined with casing 14 and cement 16. A perforation gun 18 is mounted on the lower end of the apparatus 10. As will be described more fully below, the apparatus 10 is releasably mounted within a section of tubing 20 and within a cylindrically shaped sleeve 22 threadably engaged to the lower end of the tubing 20. After the perforation gun 18 has been fired to perforate the casing 14, the cement 16 and the surrounding geologic formation as shown in FIG. 2, the perforation gun assembly 24 comprising the apparatus 10 of the invention and the attached perforation gun 18 is released to fall into the bottom of the well bore 12.

Figure 3:
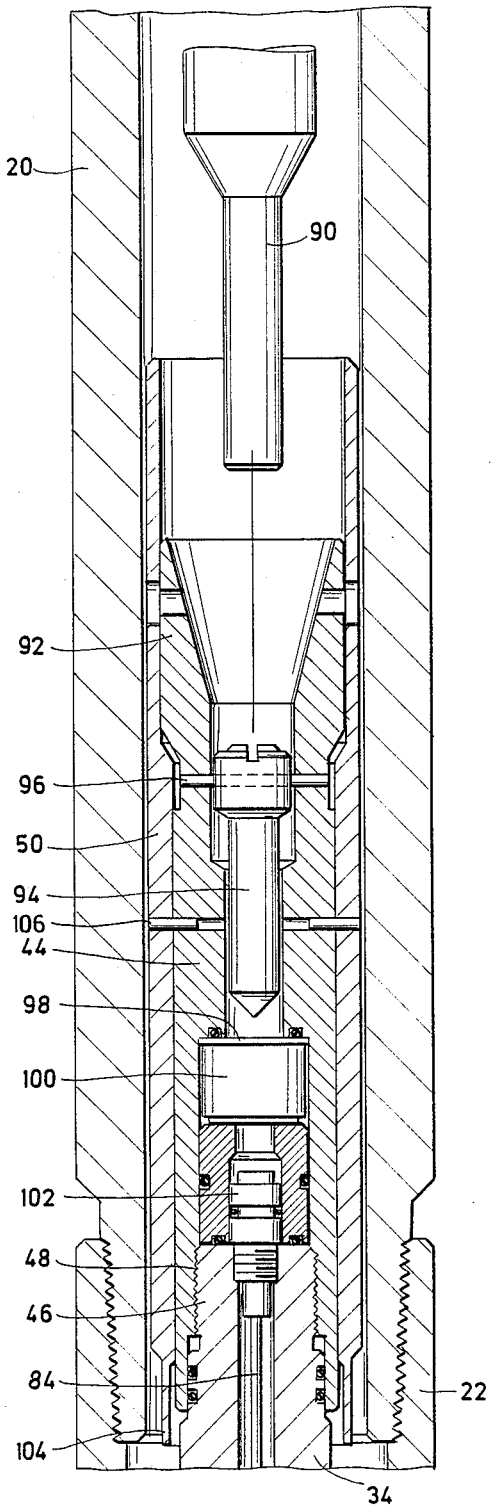
FIG. 3 is a longitudinal cross-sectional view of the upper portin of the apparatus of the invention.
Figure 4:
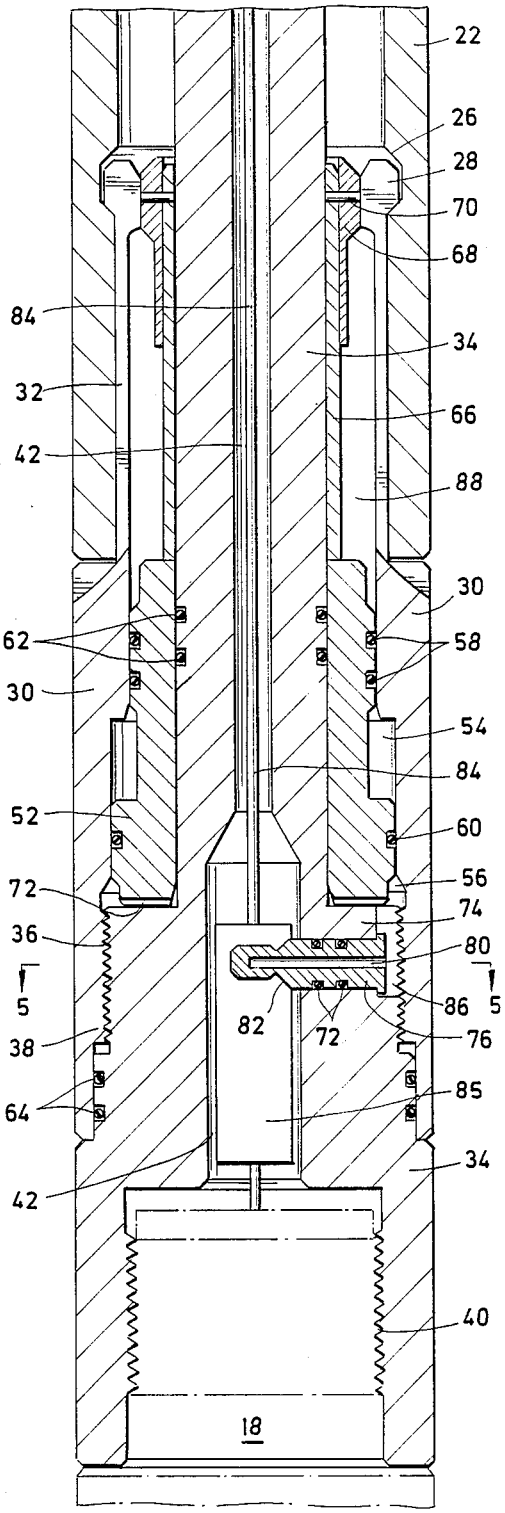
FIG. 4 is a longitudinal cross-sectional view of the lower portion of the apparatus of the invention.
Figure 6:
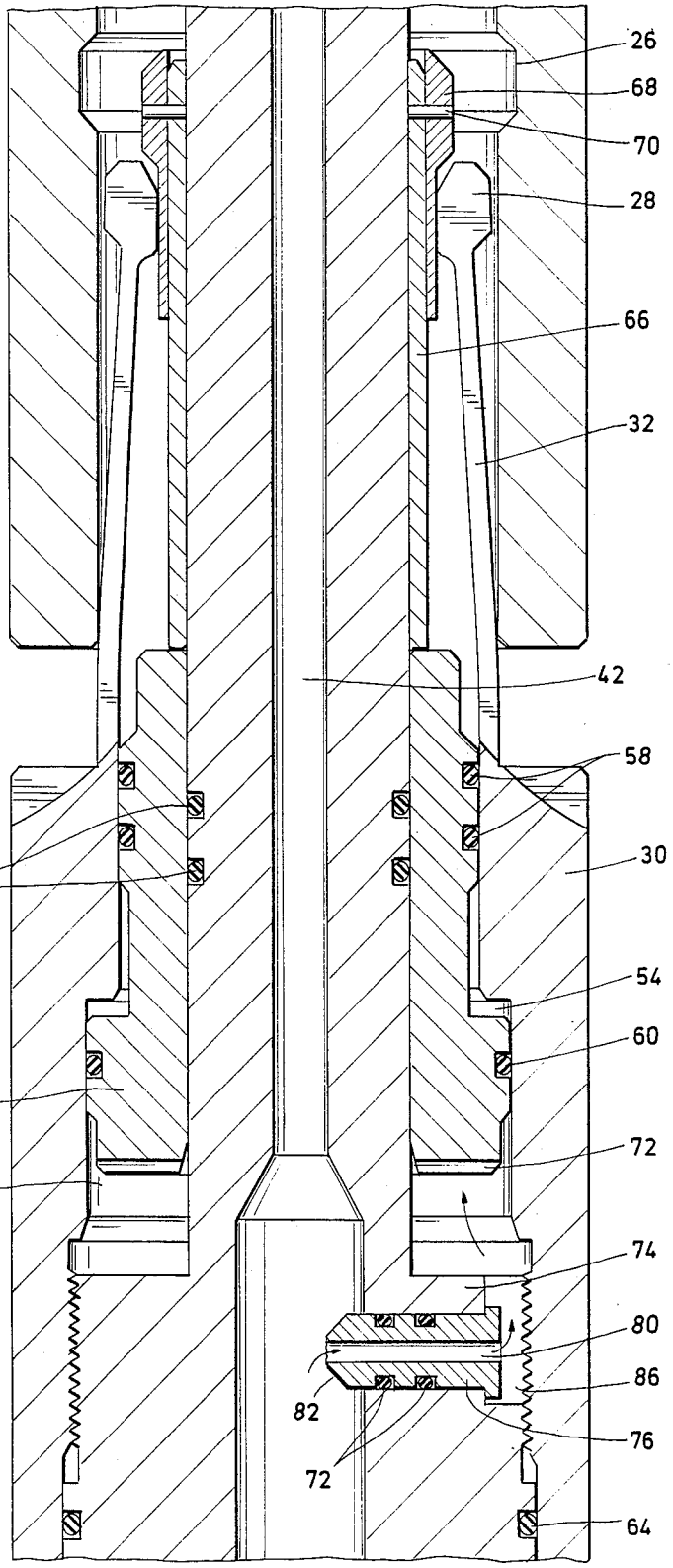
FIG. 6 is a longitudinal cross-sectional view of a portion of the apparatus of the invention showing the operation of an automatic release mechanism.

The apparatus 10 of the invention is depicted in more detail in the cross-sectional views shown in FIG. 3 and FIG. 4. A circumferential groove 26 is cut into the interior wall of sleeve 22 to receive collet fingers 28. The collet fingers 28 are connected to a cylindrically symmetrical sleeve 30 via collet members 32. The apparatus 10 of the invention may be released from tubing 20 and sleeve 22 by causing the collet fingers 28 to move out of engagement with groove 26. FIG. 4 depicts the position of the collet fingers 28 and the collet members 32 when the collet fingers 28 are engaged within groove 26. FIG. 6 depicts the position of the collet fingers 28 and the collet members 32 when the collet fingers 28 are disengaged from groove 26. When the collet fingers 28 are disengaged from groove 26, the weight of the apparatus 10 of the invention and the perforation gun 18 mounted within it causes the entire perforation gun assembly 24 to fall out of tubing 20 and sleeve 22 and fall to the bottom of the well bore 12.

A central sleeve 34 is disposed within and along the cylindrical axis of the tubing 20 and within and along the cylindrical axis of the sleeves, 22 and 30, as shown in FIG. 3 and FIG. 4. Sleeve 34 is threadably connected to sleeve 30 via the threaded engagement of threaded surface 36 of sleeve 34 and the threaded surface 38 of sleeve 30. The lower end of sleeve 34 is formed having a threaded surface 40 on the cylindrically shaped interior wall of sleeve 34 for threadably engaging the perforation gun 18 (shown in dotted outline in FIG. 4) used to perforate the walls of the well casing 14. Central sleeve 34 is also formed having portions defining a central bore 42 through sleeve 34. When central sleeve 34 is threadably connected to sleeve 30 and sleeve 30 is engaged within sleeve 22, then the central bore 42 of sleeve 34 is aligned with the cylindrical axis of tubing 20 and with the cylindrical axis of sleeves, 22 and 30. The upper end of central sleeve 34 is threadably connected to detonator housing sleeve 44 via the threaded engagement of threaded surface 46 of sleeve 34 and threaded surface 48 of detonator housing sleeve 44. A secondary release sleeve 50, the operation of which will be explained more fully below, is disposed between detonator housing sleeve 44 and the inner walls of tubing 20.

In the preferred embodiment of the invention, a cylindrically symmetrical annular piston 52 is disposed between the interior walls of sleeve 30 and the exterior walls of central sleeve 34. Piston 52 is formed having portions that form a chamber 54 between the walls of piston 52 and the walls of sleeve 30. In addition, piston 52 is also formed having portions that form a chamber 56 between the walls of piston 52, sleeve 30, and central sleeve 34. As piston 52 moves upwardly with respect to central sleeve 34, the size of chamber 56 increases and the size of chamber 54 decreases as shown in FIG. 4 and FIG. 6. O-rings 58 and O-ring 60 seal chamber 54 and prevent the entry of external fluids or pressure into chamber 54. The pressure in chamber 54 remains at approximately atmospheric pressure. Similarly, chamber 56 is also sealed by O-ring 60, and by O-rings 62 between central sleeve 34 and piston 52 and by O-rings 64 between sleeve 30 and central sleeve 34. The pressure in chamber 56 is initially at atmospheric pressure. However, when the perforation gun release mechanism is activated, the pressure in chamber 56 increases until it equals the bottom hole pressure.

The upper end of piston 52 abuts a cylindrically symmetrical release sleeve 66 disposed around central sleeve 34 as shown in FIG. 3. A cam sleeve 68 engaging each collet finger 28 is mounted via a shear pin 70 at the top of release sleeve 66 opposite the collet fingers 28. When the base 72 of piston 52 is resting on shoulder 74 of central sleeve 34, the cam sleeve 68 engages each collet finger 28 and keeps each collet finger 28 engaged within groove 26. When piston 52 is moved upwardly with respect to central sleeve 34, piston 52 causes release sleeve 66 to move upwardly with respect to central sleeve 34. This, in turn, causes the cam sleeve 68 to move upwardly out of contact with the collet fingers 28, thereby causing each collet finger 28 to be moved out of engagement with groove 26 by its corresponding collet member 32.

A break plug 76 is mounted within an aperture through the wall of central sleeve 34 as shown in FIG. 4. In the preferred embodiment of the invention, break plug 76 is cylindrically symmetrical in shape. Therefore, the crosssectional side view of break plug 76 shown in FIG. 4 is the same as the cross-sectional top view of break plug 76 shown in FIG. 5. FIG. 5 depicts a lateral cross-sectional view of the apparatus of the invention taken through break plug 76, central sleeve 34 and sleeve 30. Of course, shapes other than cylindrical shapes may be employed in constructing break plug 76. O-rings 78 around break plug 76 prevent the flow of well fluids and pressure through the juncture between break plug 76 and the walls of the break plug aperture through central sleeve 34.

The body of break plug 76 is formed having a central passageway 80 extending from the end of break plug 76 that is located nearest to sleeve 30 to the center of the end of break plug 76 located near the cylindrical axis of symmetry of central sleeve 34. As shown in FIGS. 4 and 5, the closed end of break plug 76 within the bore 42 of central sleeve 34 is formed having a notch 82 cut partially through the body of break plug 76. When the detonating cord 84 that is located next to break plug 76 explodes, the notched end of break plug 76 breaks open and thereby opens passageway 80 to the pressure that is present within the central bore 42 of central sleeve 34. To facilitate the breaking of the notched end of the break plug 76, a baffle plate 85 may be mounted within bore 42 between the detonating cord 84 and the break plug 76. The baffle plate 85 provides an area larger than the notched end of the break plug 76 for the explosive forces to act against. The result is that a larger force will be exerted against the baffle plate 85 than would be exerted against the break plug 76 in the absence of a baffle plate. The large force exerted against the baffle plate 85 is in turn exerted against the notched end of break plug 76 to break open break plug 76.

After having opened passageway 80 through break plug 76, the explosion of the detonating cord 84 then causes the perforation gun 18 to fire thereby creating perforations in the well casing. The perforations in the well casing cause the perforation gun 18 to fill with well fluid from outside the well casing 14. The well fluid that enters the perforation gun 18 is at bottom hole pressure. The well fluid at bottom hole pressure then flows into the central bore 42 of central sleeve 34. As shown in FIG. 6, the bottom hole pressure is then transmitted through passageway 80 of break plug 76, through the chamber 86 formed by the walls of break plug 76, central sleeve 34, and sleeve 30, and through the air space 56 to the base 72 of piston 52 resting on shoulder 74 of central sleeve 34.

The bottom hole pressure acting on the base 72 of piston 52 is contained within air space 56 by O-rings 62 and O-ring 60 and is prevented from reaching chamber 54. The top end of piston 52 that abuts release sleeve 66 is also exposed to bottom hole pressure. The bottom hole pressure present at the top end of piston 52 is permitted to enter into the annular space 88 between sleeve 22 and central sleeve 34 through vents (not shown) in sleeve 22. O-rings 62 and O-rings 58 prevent the bottom hole pressure within the annular space 88 from reaching chamber 54.

There is a force differential between the top of piston 52 and the base 72 of piston 52 due to the fact that the total area of the top of piston 52 is smaller than the total area of the base 72 of piston 52, and due to the fact that the pressure within chamber 54 is at atmospheric pressure. Piston 52 is therefore acted upon by unequal forces and will move upwardly with respect to central sleeve 34. The upward movement of piston 52 lifts release sleeve 66 to disengage the cam sleeve 68 from the collet fingers 28 as previously described.

In operation, a watertight perforation gun 18 (shown in dotted outline in FIG. 4) is threadably secured within the lower portion of central sleeve 34 via threaded engagement with the threaded surface 40. Detonating cord 84 is connected to the explosive devices in the perforation gun 18. The apparatus as shown in FIG. 3 and FIG. 4, together with the threadedly engaged perforation gun 18, is then lowered into the well casing 14 to the required depth.

When the operator desires to fire the perforation gun 18, he drops a firing bar 90 (shown in FIG. 3) into the tubing string. When the firing bar 90 falls to the end of the last section of tubing 20, it hits the slanted drop bar guide 92 of detonator housing sleeve 44 which guides the firing bar 90 onto firing pin 94. The impact of the firing bar 90 on the firing pin 94 breaks the shear pin 96 which holds firing pin 94 within detonator housing sleeve 44 and drives the firing pin 94 against watertight seal 98 of a percussion detonator 100 mounted within detonator housing sleeve 44. The impact of the firing pin 94 against watertight seal 98 and percussion detonator 100 causes the percussion detonator 100 to detonate.

The detonation of percussion detonator 100 in turn causes a receptor detonator 102 mounted within detonator housing sleeve 44 to detonate. Receptor detonator 102 then in turn causes detonating cord 84 mounted within the central bore 42 of central sleeve 34 to detonate. The detonating cord 84 detonates along its length at the speed of approximately eight thousand meters per second (8,000 m/sec). As the detonating cord 84 detonates, it radiates explosive force in all directions as it detonates along its length. As the detonation of the detonating cord 84 passes the break plug 76, the explosive force acts on the notched end of the break plug 76, causing it to break at the notch 82. If a baffle plate 85 is used to increase the force exerted on the break plug 76, the explosive force acts on the baffle plate 85 to force it against the break plug 76, as previously described. When the end of break plug 76 is broken, passageway 80 is opened to allow fluid communication between the central bore 42 of central sleeve 34 and the air space 56 via chamber 86. The subsequent flow of well fluid into the central bore 42 of central sleeve 34, passageway 80, chamber 86, and air space 56 transmits the bottom hole pressure to the base 72 of piston 52. The pressure differential at the two ends of piston 52 lifts piston 52 as previously described, thereby automatically releasing the perforation gun assembly 24 to fall to the bottom of the well bore 12.

If the automatic release of the perforation gun assembly 24 fails to occur for some reason, such as a mechanical obstruction, it is possible to mechanically release the perforation gun assembly with the aid of secondary release sleeve 50. As shown in FIG. 3, secondary release sleeve 50 is disposed between the interior walls of tubing 20 and the exterior walls of detonator housing sleeve 44. The upper end of secondary release sleeve 50 is open to receive firing bar 90. The lower end of secondary release sleeve 50 is formed into a cylindrically symmetrical release flange 104 that is aligned with the cam sleeve 68. Secondary release sleeve 50 is releasably fastened to detonator housing sleeve 44 via shear pin 106.

When the operator desires to mechanically release the perforation gun assembly 24 with secondary release sleeve 50, the operator causes a thrust device (not shown) to be lowered into the tubing string to impact secondary release sleeve 50 and break shear pin 106. The thrust device may be a retrievable device that is mounted on a wireline or may be a non-retrievable device such as a pump-down unit. If a non-retrievable thrust device is used, it simply follows the perforation gun assembly 24 into the well bore 12 after the release mechanism has been triggered.

When shear pin 106 is broken, the weight of secondary release sleeve 50 causes it to fall. The release flange 104 then strikes the cam sleeve 68. The impact of release flange 104 against the cam sleeve 68 causes the shear pins 70 to break, thereby causing the cam sleeve 68 to separate from the release sleeve 66 on which they were mounted. Release flange 104 then drives the cam sleeve 68 downward out of engagement with the collet fingers 28 as shown in FIG. 7. The collet fingers 28 then disengage themselves from groove 26 due to the action of the collet members 32. The disengaged collet fingers 28 then rest on the side of release flange 104 as shown in FIG. 7.

A first alternate embodiment of the invention is shown in FIGS. 8 and 9. In this form of the invention the perforation gun 18 (not shown in FIG. 8 or FIG. 9) is threadably secured to a sleeve 108. The sleeve 108 is fastened to the tubing 20 by means of two balls 110 set within a recess 112 in the interior walls of sleeve 108. Recess 112 in the walls of sleeve 108 may take the form of a circumferential groove. The balls 110 are held in place by a frangible rod 114 made of cast iron or similar material. Each end of frangible rod 114 extends through passageways, 116 and 118, through the walls of tubing 20. Each ball 110 is held in place within recess 112 by each end of frangible rod 114 as shown in FIGS. 8 and 9. An O-ring 120 prevents external fluid from reaching the interior of sleeve 108. When the detonating cord 84 is exploded, the explosion causes frangible rod 114 to break, thereby permitting the balls 110 to roll inwardly in passageways, 116 and 118, and out of recess 112. Because the speed of the detonation of detonating cord 84 is so great, the perforation gun 18 will be triggered to fire before sleeve 108 has fallen very far from the tubing 20. As previously described, a baffle plate 121 may be used to increase the force acting to break frangible rod 114.

A similar second alternate embodiment of the invention is shown in FIGS. 10 and 11. In this form of the invention, the perforation gun 18 (not shown in FIG. 10 or FIG. 11) is threadably secured to a sleeve 122. The sleeve 122 is fastened to the tubing 20 by means of two balls 124 set within a recess 126 in the interior walls of sleeve 122. Recess 126 in the walls of sleeve 122 may take the form of a circumferential groove. Each of the balls 124 is held in place within recess 126 by a flanged non-frangible rod 128. The flanged end of each rod 128 abuts the undetonated detonating cord 84. One rod 128 extends through passageway 130 and the other rod 128 extends through passageway 132 as shown in FIG. 10 and FIG. 11. An O-ring 134 prevents external fluid from reaching the interior of sleeve 122.

After the detonating cord 84 has been detonated, the rods 128 are no longer pushed against the balls 124. The weight of sleeve 122 causes the balls 124 to roll out of recess 126 into their respective passageways, 130 and 132, pushing the rods 128 toward the center of tubing 20. Sleeve 122 is then free to fall to the bottom of the well bore 12. Because the speed of the detonation of the detonating cord 84 is so great, the perforation gun 18 will be triggered to fire before sleeve 122 has fallen very far from the tubing 20.

Although the first alternate embodiment and the second alternate embodiment described above have been shown with two retaining balls, it is evident that the release mechanism can also be made to function with one ball or with three or more balls. It is evident from the foregoing that an improved apparatus for releasing a perforation gun has been described and that the improved apparatus overcomes disadvantages found in prior art devices. While the invention has been particularly shown and described with reference to preferred and alternate embodiments thereof, it will be understood by those skilled in the art that various changes in size, shape, symmetry, materials and in the details of this illustrated apparatus may be made within the scope of the appended claims without departing from the scope of the invention.

What is claimed is:

1. A perforating gun assembly including a releasable coupling for releasing a perforation gun from a tubing string in a well casing after perforation of said well casing, comprising:

a housing releasably connected to said tubing string;

explosive means mounted within said housing for perforating said well casing;

means mounted within said housing for detonating said explosive means to perforate said well casing; and means for releasing said perforation gun assembly, comprising, release means for disconnecting said housing from said tubing string, a piston abutting said release means for actuating said release means, a break plug mounted within said assembly, said break plug having portions forming a passageway partially through said break plug, said passageway providing communication between said piston and the pressure that is present inside the well casing after the passageway of said break plug has been opened, and a baffle plate mounted within said assembly between said break plug and said means for detonating said explosive means to perforate said well casing.

2. A perforating gun assembly including a releasable coupling for releasing a perforation gun from a tubing string in a well casing after perforation of said well casing, comprising:

a first sleeve having collet fingers mounted on collet members, said collet fingers adapted to engage a groove in a second sleeve connected to said tubing string;

a central sleeve threadedly connected to said first sleeve, said central sleeve having portions defining a central bore through said central sleeve;

a perforation gun mounted within said central sleeve for perforating said well casing;

detonator means mounted within said central sleeve for detonating said perforation gun to perforate said well casing;

first means for releasing said perforation gun assembly, comprisiring, a release sleeve slidingly disposed around said central sleeve, a cam sleeve mounted on said release sleeve for engaging said collet fingers to engage said collet fingers ithin said groove of said second sleeve, a piston slidingly disposed between said first sleeve and said central sleeve, said piston abutting an edge of said release sleeve, and means for moving said piston against said release sleeve to disengage said cam sleeve mounted on said release sleeve from said collet fingers, said means for moving said piston utilizing the pressure that is present within the central bore of said central sleeve after said detonator means within said perforation gun assembly has detonated said perforation gun; and second, alternate means for releasing said perforation gun assembly, comprising, a mechanically releasable secondary release sleeve slidably disposed between said tubing string and said central sleeve, said secondary release sleeve having portions defining a release flange said release flange of said secondary release sleeve being adapted to move said cam sleeve out of engagement with said collet fingers when said secondary release sleeve is mechanically released to slide with respect to said tubing string.

3. An apparatus as claimed in claim 2, wherein said means for moving said piston against said release sleeve comprises:

a break plug mounted with an aperture through said central sleeve, said break plug having portions forming a passageway partially through said break plug, said passageway providing communication between said piston and the central bore of said central sleeve after the passageway of said break plug has been opened.

4. An apparatus as claimed in claim 3 together with:

a baffle plate mounted within said central sleeve between said break plug and said detonator means.

5. A perforating gun assembly including a releasable coupling for releasing a perforation gun from a tubing string in a well casing after perforation of said well casing, comprising:

a housing releasably connected to said tubing string;

explosive means mounted within said housing for perforating said well casing;

detonating means mounted within said housing for detonating said explosive means to perforate said well casing;

means for releasing said perforation gun assembly, comprising, a plurality of balls wherein at least one ball is artially set within a recess within the interior wall of said housing, and also is partially set within a passageway through said tubing string, and a frangible rod, said rod having one of its ends disposed within said passageway abutting said ball in said recess and having some portion disposed within said tubing string adjacent to said detonating means for detonating said explosive means and said frangible rod adapted to shatter when said detonating means within said housing detonates, thereby permitting said ball to roll inwardly within said passageway and out of engagement with the recess within the interior wall of said housing.

6. An apparatus as claimed in claim 5 together with a baffle plate mounted within said tubing string between said frangible rod and said detonating means for detonating said explosive means.

7. A perforating gun assembly including a releasable coupling for releasing a perforation gun from a tubing string in a well casing after perforation of said well casing, a housing releasably connected to said tubing string;

explosive means mounted within said housing for perforating said well casing;

detonating means mounted within said housing for detonating said explosive means to perforate said well casing;

means for releasing said perforation gun assembly, comprising, two balls, each of said two balls being partially set within a recess within the interior wall of said housing, the first of said two balls also being partially set within a first passageway through said tubing string, and the second of said two balls also being partially set within a second passageway through said tubing string, and a frangible rod, said rod having one of its ends disposed within said first passageway abutting said first ball in said recess and having the other of its ends disposed within said second passageway abutting said second ball in said recess and having some portion disposed within said tubing string adjacent to said detonating means for detonating said explosive means and said frangible rod adapted to shatter when said detonating means within said housing detonates, thereby permitting said first and second balls to roll inwardly within their respective passageways and out of engagement with the recess within the interior wall of said housing.

8. An apparatus as claimed in claim 7 together with a baffle plate mounted within said tubing string between said frangible rod and said detonating means for detonating said explosive means.

9. A perforating gun assembly including a releasable coupling for releasing a perforation gun from a tubing string in a well casing after perforation of said well casing, comprising:

a housing releasably connected to said tubing string;

explosive means mounted within said housing for perforating said well casing;

detonating means mounted within said housing for detonating said explosive means to perforate said well casing;

means for releasing said perforation gun assembly, comprising, two balls, each of said two balls being partially set within a recess within the interior wall of said housing, the first of said two balls also being partially set within a first passageway through said tubing string, and the second of said two balls also being partially set within a second passageway through said tubing string, a first non-frangible flanged rod disposed within said first passageway abutting said first ball in said recess, and a second non-frangible flanged rod disposed within said second passageway abutting said second ball in said recess, said first non-frangible flanged rod and said second non-frangible flanged rod also abutting said detonating means within said housing and said first nonfrangible flanged rod and said second non-frangible flanged rod adapted to move toward the center of said tubing string after said detonating means has detonated, thereby permitting said first and second balls to roll inwardly within their respective passageways and out of engagement with the recess within the interior wall of said housing.

10. A perforating gun assembly including a releasable coupling for releasing a perforation gun from a tubing string in a well casing after perforation of said well casing, comprising:

a housing releasably connected to said tubing string;

explosive means mounted within said housing for perforating said well casing;

means mounted within said housing for detonating said explosive means to perforate said well casing; and means for releasing said perforation gun assembly, comprising, release means for disconnecting said housing from said tubing string, a piston abutting said release means for actuating said release means, said piston having first and second ends with unequal surface areas, the surface area of said first end being less than the surface area of said second end, said first end continuously in fluid communication with the pressure that is present inside said well casing, said second end in fluid communication with the pressure that is present inside said well casing only after said explosive means within said perforating gun assembly has perforated said well casing; and means for actuating said piston with the pressure that is present inside the well casing after said explosive means within said perforation gun assembly has perforated said well casing.

11. An apparatus as claimed in claim 10 wherein said means for actuating said piston with the pressure that is present inside the well casing after said explosive means within said perforation gun assembly has perforated said well casing comprises:

a break plug mounted within said assembly, said reak plug having portions forming a passageway partially through said break plug, said passageway providing communication between said piston and the pressure that is present inside the well casing after the passageway of said break plug has been opened.

12. An apparatus as claimed in claim 11 together with a baffle plate mounted within said assembly between said break plug and said means for detonating said explosive means to perforate said well casing.

13. An apparatus as claimed in claim 12 together with second, alternate means for releasing said perforation gun assembly, comprising, a mechanically releasable secondary release sleeve slidably disposed between said tubing string and said central sleeve, said secondary release sleeve having portions defining a release flange, said release flange of said secondary release sleeve being adapted to move said cam sleeve out of engagement with said collet fingers when said secondary release sleeve is mechanically released to slide with respect to said tubing string.

14. An apparatus as claimed in claim 10 together with second, alternate means for releasing said perforation gun assembly, comprising, a mechanically releasable secondary release sleeve slidably disposed between said tubing string and said central sleeve, said secondary release sleeve having portions defining a release flange, said release flange of said secondary release sleeve being adapted to move said cam sleeve out of engagement with said collet fingers when said secondary release sleeve is mechanically released to slide with respect to said tubing string.

* * * * *

UNITED STATES PATENT AND TRADEMARK OFFICE

CERTIFICATE OF CORRECTION

PATENT NO. : 4,756,363

DATED : July 12, 1988

INVENTOR(S) : C.P. Lanmon II et al

It is certified that error appears in the above-identified patent and that said Letters Patent is hereby corrected as shown below:

In Column 8, line 49, delete "comprisiring" and insert therefor --comprising--.

In Column 9, line 35, delete "artially" and insert therefor --partially--.

In Column 11, line 23, delete "reak" and insert therefor --break--.

Signed and Sealed this

Thirteenth Day of December, 1988

*Attest:*

DONALD J. QUIGG

*Attesting Officer*

*Commissioner of Patents and Trademarks*